US006817321B2

(12) United States Patent
Takei et al.

(10) Patent No.: US 6,817,321 B2
(45) Date of Patent: Nov. 16, 2004

(54) METHOD FOR CONTROLLING ELECTRONICALLY-CONTROLLED THERMOSTAT

(75) Inventors: Toshiharu Takei, Tokyo (JP); Yuichi Murata, Tokyo (JP)

(73) Assignee: Nippon Thermostat Co., Ltd., Kiyose (JP)

( * ) Notice: Subject to any disclaimer, the term of this patent is extended or adjusted under 35 U.S.C. 154(b) by 58 days.

(21) Appl. No.: 10/432,721

(22) PCT Filed: Sep. 3, 2002

(86) PCT No.: PCT/JP02/08957

§ 371 (c)(1),
(2), (4) Date: May 27, 2003

(87) PCT Pub. No.: WO03/033887

PCT Pub. Date: Apr. 24, 2003

(65) Prior Publication Data

US 2004/0041035 A1 Mar. 4, 2004

(30) Foreign Application Priority Data

Oct. 15, 2001 (JP) ..... 2001-316162

(51) Int. Cl.[7] ..... F01P 07/14
(52) U.S. Cl. ..... 123/41.09; 165/300; 236/34
(58) Field of Search ..... 123/41.09, 41.1, 123/41.13; 165/299, 300; 236/34, 34.5

(56) References Cited

U.S. PATENT DOCUMENTS 5,404,842 A 4/1995 Matsushiro et al.
5,738,048 A * 4/1998 Suzuki et al. ..... 123/41.1
5,799,625 A * 9/1998 Ziolek et al. ..... 123/41.1
6,055,947 A 5/2000 Okuno
6,655,326 B2 * 12/2003 Purcell et al. ..... 123/41.31
2003/0079698 A1 * 5/2003 Morgan et al. ..... 123/41.1

FOREIGN PATENT DOCUMENTS

JP 2001-27120 1/2001

* cited by examiner

*Primary Examiner*—William E. Tapolcai
(74) *Attorney, Agent, or Firm*—Oblon, Spivak, McClelland, Maier & Neustadt, P.C.

(57) ABSTRACT

A control to enable a further degree of enhancement in combustion efficiency in an automobile by effectively performing temperature control of cooling water in an automobile engine in accordance with various states of operation. Parameters from a variety of sensors that detect the state of an automobile engine are input into an engine control unit. Then, when the engine control unit determines from values of the accelerator opening and engine rotation speed, which serve as parameters indicating the operating state of the automobile, that the engine load is about to decrease, control is performed in the electronic control thermostat to maintain the cooling water temperature at a high temperature. Conversely, when it is determined that medium or high loads are due to increase, the control method is switched such that the electronic control thermostat is controlled by reading a target temperature corresponding to these parameter values from the engine control unit. Thus the electronic control thermostat variably sets the cooling water temperature in an engine cooling water temperature control system to a desired state in accordance with the engine load.

16 Claims, 10 Drawing Sheets

| FLOW RATE RATIO | 0 | 0.2 | 0.3 | 0.4 | 0.5 | 0.6 | 0.8 |
|---|---|---|---|---|---|---|---|
| BASIC VALVE OPENING D | D01 | D02 | D03 | D04 | D05 | D06 | D07 |

| ENGINE ROTATION SPEED / VALVE OPENING | 500 | 1000 | 1500 | 2000 | | 5500 | 6000 |
|---|---|---|---|---|---|---|---|
| 0 DEGREES | L11 | L12 | L13 | L14 | | L1m | L1n |
| 10 DEGREES | L21 | L22 | L23 | L24 | | L2m | L2n |
| 20DEGREES | L31 | L32 | L33 | L34 | | L3m | L3n |
| 30 DEGREES | L41 | L42 | L43 | L44 | | L4m | L4n |
| 40 DEGREES | L51 | L52 | L53 | L54 | | L5m | L5n |
| 50 DEGREES | L61 | L62 | L63 | L64 | | L6m | L6n |
| 60 DEGREES | L71 | L72 | L73 | L74 | | L7m | L7n |
| 70 DEGREES | L81 | L82 | L83 | L84 | | L8m | L8n |
| 80 DEGREES | L91 | L92 | L93 | L94 | | L9m | L9n |

*FIG. 11*

| Th - OUTSIDE AIR TEMPERATURE / RADIATOR TRANS-MISSION FLOW RATE L | 60°C | 50°C | 40°C | 30°C |
|---|---|---|---|---|
| L11 | Tdxx | Tdxx | Tdxx | Tdxx |
| L12 | Tdxx | Tdxx | Tdxx | Tdxx |
| L13 | Tdxx | Tdxx | Tdxx | Tdxx |
| L14 | Tdxx | Tdxx | Tdxx | Tdxx |
| | | | | |
| L8m | Tdxx | Tdxx | Tdxx | Tdxx |
| L9n | Tdxx | Tdxx | Tdxx | Tdxx |

*FIG. 12*

METHOD FOR CONTROLLING ELECTRONICALLY-CONTROLLED THERMOSTAT

TECHNICAL FIELD

The present invention relates to a control method for an electronic control thermostat which is used to control the temperature of cooling water in a cooling water temperature control system of an internal combustion engine (to be referred to as "engine" hereinafter) used in an automobile or the like in which the temperature of cooling water is set variably in accordance with the engine load.

BACKGROUND ART

A water-cooling type cooling device which uses a radiator is typically used in an automobile engine to cool the engine. A thermostat which uses a thermal expansion body to adjust the amount of cooling water recirculated on the radiator side or an electronically controlled valve unit has been used conventionally in this type of cooling device to control the temperature of the cooling water which is introduced into the engine with the aim of improving combustion efficiency in the automobile.

More specifically, a control valve of such a thermostat using a thermal expansion body or an electronically controlled valve unit is interposed in one portion of a cooling water passage such that when the temperature of the cooling water is low, the control valve is closed such that the cooling water is recirculated through a bypass passage rather than through the radiator, and when the temperature of the cooling water increases, the control valve is opened such that the cooling water is recirculated through the radiator. Thus the temperature of the cooling water can be controlled to a desired state.

Conventionally, the cooling water temperature control described above is performed by setting a target temperature arbitrarily. In some control systems employed in commercially available automobiles, for example, control is performed in accordance with a map comprising temperatures inputted in advance and data which is calculated in an engine control unit from various parameters such as the cooling water temperature, outside air temperature, vehicle speed, and engine rotation speed, for example, and linear control is hoped to be achieved by finely dividing these set temperatures.

It is also known that combustion efficiency in an automobile can be enhanced by reducing the cooling water temperature when the engine is running at high load and increasing the cooling water temperature when the engine is running at low load.

A large number of devices and methods employing various control systems have been disclosed in the background art with the object of improving combustion efficiency by performing cooling water temperature control to a desired state.

In Japanese Patent Application Laid-Open Publication No. H5-332136, for example, a method is disclosed as a method for controlling the temperature of cooling water in an engine in which precise temperature control is performed in accordance with the operating region such that even rapid rises in the temperature of the cooling water can be sufficiently addressed. In this conventional example, sensors for detecting temperature are provided in a cooling water passage on the inlet side and outlet side of the engine, and the detected values thereof are used selectively in accordance with the engine load to control the opening and closing of a control valve.

A cooling control device and cooling control method for an internal combustion engine (engine) are disclosed in Japanese Patent Application Laid-Open Publication No. H10-331637 in which temperature change in the cooling water is reduced as far as possible under any state of operation such that the engine runs at as high a temperature as possible without overheating. This conventional example is programmed to perform so-called constant water temperature control in which appropriate parameters indicating the operating state of the engine are used to read temperature drops in the cooling water from a table-format map, whereby temperature management is performed by predicting changes in the temperature of the cooling water.

In Japanese Patent Application Laid-Open Publication No. H5-222932, a cooling control device for an internal combustion engine (engine) is disclosed in which signals from a pressure sensor and an intake air temperature sensor which detect the density of intake air are read to calculate the density of the intake air, and control is performed such that the temperature on the inlet side of the engine is reduced further as the density increases and the temperature of the cooling water is increased further as the density decreases. In this conventional example, so-called map control is performed to control the cooling water temperature by detecting engine operating conditions such as the engine rotation speed and load and reading set temperatures from a map which is preset on the basis of these operating conditions.

Such devices and methods which perform cooling water temperature control through constant water temperature control or map control as described above have been disclosed in the background art in large numbers, but each has drawbacks and advantages and there is yet to be disclosed a device or method which is capable of further improving combustion efficiency by performing efficient cooling water temperature control in accordance with any operating state.

For example, the cooling water temperature control of the aforementioned conventional examples has defects such as the following.

That is, if cooling water temperature control is performed with great precision, the volume of data increases such that further labor is required and costs rise.

Further, it is impossible in actuality to control the temperature of cooling water synchronously with the required state of the engine. This is because the engine state changes constantly, and hence even if an attempt is made to calculate this state using a central processing unit CPU such as an engine control unit ECU and transmit signals to a thermostat valve or the like in order to alter the cooling water temperature to a target water temperature, a delay caused in the meantime by water temperature hunting or the like is inevitable. In short, even when such control is performed, several seconds or more are always required to reach the target temperature.

It is said that combustion efficiency may be improved during normal operations and mode operations by correcting various effective cooling water temperatures, ignition timings, and so on to optimum values using the engine control unit ECU. However, this is dependent upon certain fixed conditions being satisfied, and the actual effect thereof when a regular driver, and particularly a novice driver, drives normally is often small.

Furthermore, achieving linear control of the cooling water temperature to an optimum water temperature in conjunction with the actual state of operation is difficult from the point of view of responsiveness due to the course which must be followed to achieve the target temperature, namely detection of the cooling water temperature, calculation and control in the engine control unit ECU, operation of the electronic control thermostat on the basis thereof, and alteration of the flow of the cooling water in accordance therewith.

The present invention has been designed in consideration of such circumstances, and it is an object thereof to provide a control method for an electronic control thermostat which appropriately predicts and determines load variation in an engine in an operative state to thereby control the temperature of cooling water appropriately and efficiently such that an improvement in combustion efficiency can be achieved with a greater degree of reliability and in substantially all regions of the operative state.

DISCLOSURE OF THE INVENTION

In order to achieve such an object, a control method for an electronic control thermostat according to the present invention is a control method in an automobile engine cooling water temperature control system in which the temperature of cooling water is set variably by an electronic control thermostat in accordance with the engine load, this method being characterized in that parameters from a variety of sensor types which detect the state of the engine are inputted into an engine control unit, and when the engine control unit determines from the values of the parameters indicating the operative state of the automobile that the engine load is about to decrease, control is switched in the electronic control thermostat to a control method (so-called high temperature constant water temperature control) in which a target temperature for controlling the cooling water temperature is maintained at a fixed high temperature at all times, and when the engine control unit determines that medium or high loads are due to increase, control is switched in the electronic control thermostat to a control method (so-called map control) in which a target temperature corresponding to the parameter values is read from the engine control unit.

In this case, the control method for an electronic control thermostat according to the present invention is characterized in that when the accelerator opening, engine rotation speed, and so on, which are parameters indicating the operative state of the automobile, satisfy predetermined conditions, the engine control unit determines by prediction whether the engine load is low load, medium load, or high load.

The control method for an electronic control thermostat according to the present invention is also characterized in that the control (so-called high temperature constant water temperature control) performed by the engine control unit wherein a target water temperature for controlling the cooling water temperature is maintained at a high temperature at all times in the electronic control thermostat is performed on the basis of the throttle opening, the engine rotation speed, and the cooling water temperature.

The control method for an electronic control thermostat according to the present invention is further characterized in that the control (so-called map control) of the electronic control thermostat which is performed by reading a target temperature corresponding to the parameter values from the engine control unit is performed on the basis of at least one of or any combination of the throttle opening, the engine rotation speed, the cooling water temperature, the atmospheric pressure, the intake air amount, the intake air humidity, and the intake air temperature.

The control method for an electronic control thermostat according to the present invention is further characterized in that the electronic control thermostat is capable of variably controlling the cooling water temperature to any temperature, and is disposed in an engine cooling water passage on either the inlet side or the outlet side of the engine.

According to the present invention, when the cooling water temperature is controlled in accordance with the engine load (to a high water temperature in a low load and to a low water temperature in a medium or high load) with the object of enhancing combustion efficiency, for example, the engine load is predicted and determined to determine whether the automobile is in high load mode or low load mode.

As examples thereof, the automobile is usually in low load mode following engine start-up. Further, it is determined that the automobile is in high load mode when a high speed is maintained for at least a fixed time period or the throttle opening increases frequently. When manual mode or sport mode is entered in an automatic car, high load mode is determined. In a vehicle equipped with a car navigation system, high load mode is determined on the basis of information from the car navigation system or the like that the car is traveling on an express highway or a mountain road.

When high load mode is switched to, map control is performed by reading [parameter values] from the engine control unit in order to realize a target water temperature in accordance with the load. Since the cooling water temperature falls faster than it rises, a low water temperature which is optimum for combustion is realized with high probability at the time of a high load.

During low load mode, constant water temperature control to a high water temperature (for example 110° C.) is performed in order to maintain the cooling water temperature at a high temperature. In so doing, a high water temperature which is optimum for combustion at the time of a low load can be realized in the majority of the operative state.

Here, any electronic control thermostat which is capable of controlling water temperature arbitrarily may be used, for example a thermostat having a WAX-PTC type constitution in which the relationship to cooling water temperature is eliminated by combining an exothermic body such as PTC with a thermostat which uses wax, a butterfly type constitution, or a rotary valve constitution.

BRIEF DESCRIPTION OF THE DRAWINGS

FIG. 11 is a constitutional diagram illustrating the form of a map which is used in the processing routine shown in FIG. 9;

FIG. 12 is a constitutional diagram illustrating in detail the form of the map which is used in the processing routine shown in FIG. 9;

BEST MODE FOR CARRYING OUT THE INVENTION

FIGS. 1 through 5 illustrate an embodiment of the control method for an electronic control thermostat according to the present invention.

First, an outline of the entire cooling water temperature control system for an automobile engine comprising an electronic control thermostat will be described below on the basis of FIG. 3 from among these drawings.

Figure 3:
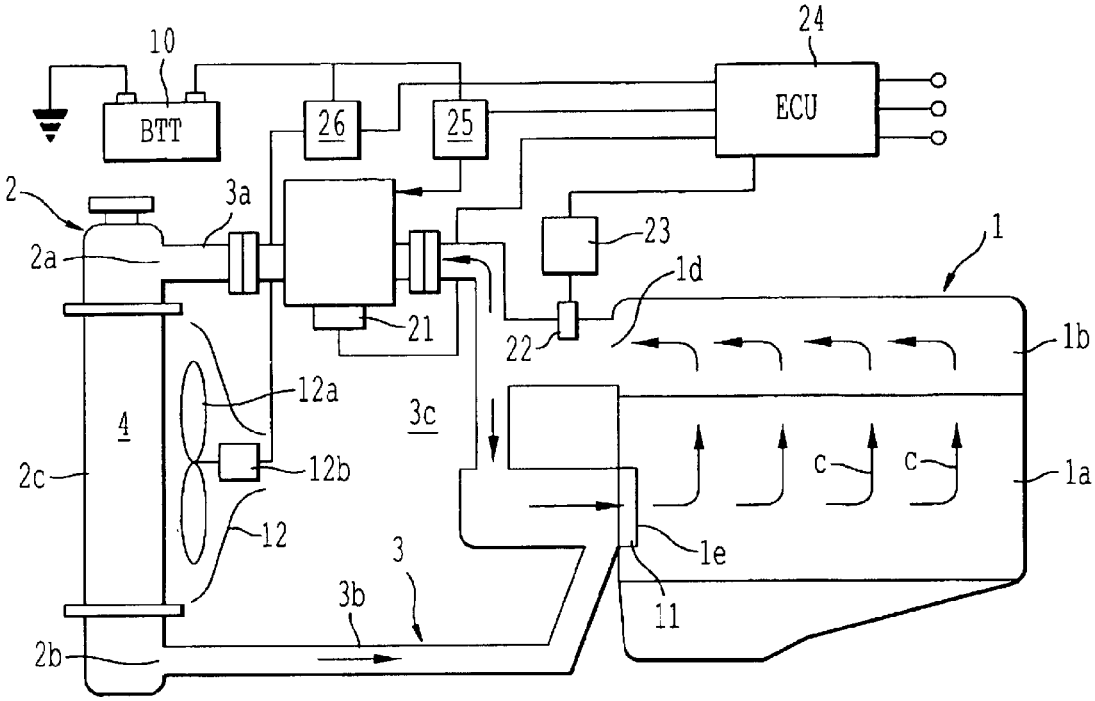
FIG. 3 is a constitutional diagram for illustrating in outline a cooling control device for an automobile engine to which the present invention is applied.

In FIG. 3, 1 is an automobile engine serving as an internal combustion engine constituted by a cylinder block 1*a* and a cylinder head 1*b*. A fluid passage shown by arrows c is formed in the interior of the cylinder block 1*a* and cylinder head 1*b* of this engine 1.

2 is a heat exchanger, or in other words a radiator, and as is well known, a fluid passage 2*c* is formed in this radiator 2. A cooling water inlet portion 2*a* and a cooling water outlet portion 2*b* of the radiator 2 are connected to a cooling water passage 3 through which cooling water is recirculated between the engine 1 [and the radiator 2].

This cooling water passage 3 is constituted by an outflow side cooling water passage 3*a* which connects a cooling water outflow portion 1*d* provided in the upper portion of the engine 1 and a cooling water inflow portion 2*a* provided in the upper portion of the radiator 2, an inflow side cooling water passage 3*b* which connects a cooling water outflow portion 2*b* provided in the lower portion of the radiator 2 and a cooling water inflow portion 1*e* provided in the lower portion of the engine 1, and a bypass water passage 3*c* which connects these cooling water passages 3*a*, 3*b* at a point thereon.

The engine 1, radiator 2, and cooling water passage 3 form a cooling medium recirculating passage 4.

A valve unit 21 using an electronic control thermostat which serves as water passage flow rate control means is provided by means of a flange connection at a point on the outflow side cooling water passage 3*a* which is disposed between the cooling water outflow portion 1*d* provided in the upper portion of the engine 1 and the cooling water inflow portion 2*a* provided in the upper portion of the radiator 2. This electronic control thermostat valve unit 21 uses a butterfly-type valve (to be referred to as "butterfly valve" hereinafter) provided within this valve unit 21, for example, and is opened and closed by the reciprocal rotating action of an electric motor (not shown), for example, to thereby adjust the flow rate of cooling water which is dispatched to the radiator 2 side.

A temperature detecting element 22 such as a thermistor is disposed in the outflow side cooling water passage 3*a* in the vicinity of the cooling water outflow portion 1*d* in the engine 1. Values detected by this temperature detecting element 22, or in other words information (to be referred to as "third information hereinafter) relating to the water temperature at the engine outlet, are converted by a converter 23 to data which are recognizable by an engine control unit (to be referred to as "ECU" hereinafter) 24, and are then supplied to the ECU 24 which controls the entire operative state of the engine 1.

Further, in the embodiment shown in FIG. 3, signals (to be referred to as "second information" hereinafter) indicating the rotation angle of the butterfly valve which are obtained by an angle sensor to be described at a later stage which is disposed in the valve unit 21 are also supplied to the ECU 24.

The ECU 24 is also provided with signals (to be referred to as "first information" hereinafter) indicating the operative state or non-operative state of a fan motor 12*b* in a fan unit 12 which serves as other forcible cooling means, signals (to be referred to as "fourth information" hereinafter) indicating the outside air temperature, signals indicating the amount of cooling medium passing through the heat exchanger, or in other words engine rotation speed information (to be referred to as "fifth information" hereinafter), and so on, although these signals are not shown in the drawings.

Figure 13:
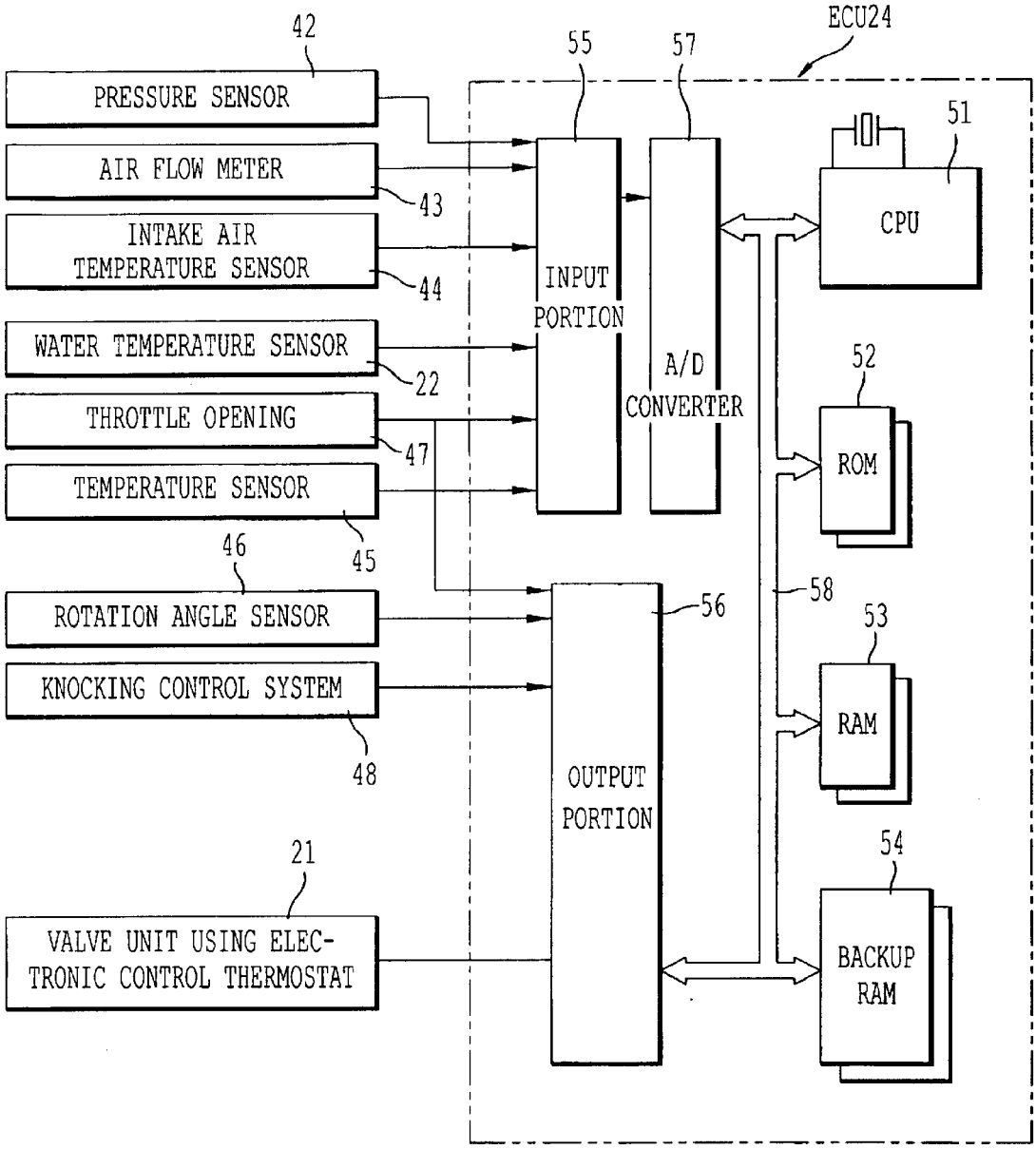
FIG. 13 is a block diagram illustrating the relationship between the ECU and various sensors which are used when map control is performed in the control method of the present invention.

As shown in FIG. 13, to be described below, the ECU 24 is provided with a pressure sensor 42 for detecting the atmospheric pressure P around the engine 1, an air flow meter 43 for detecting the amount of intake air Q, an intake air temperature sensor 44 for detecting the temperature THA of the intake air (=atmospheric temperature), a humidity sensor 45 for detecting the humidity Hu of the intake air, and a distributor (not shown). The detected output of a rotation angle sensor 46 which outputs signals corresponding to the engine rotation speed Ne, a throttle opening sensor 47 which detects the degree of opening θth of a throttle valve, and a knocking control system (KCS) 48 which detects knocking and also prevents the generation of knocking by controlling the ignition timing is inputted into the ECU 24. Note that the aforementioned pressure sensor 42 is provided on the outside of an intake pipe (not shown) of the engine 1, and detects atmospheric pressure around the engine 1 at all times, even when the engine 1 is in an operative state.

In addition to the first through fifth information and the information from the sensors 42 to 48 described above, the ECU 24 executes calculation processing to be described hereinafter, and generates a command signal which is provided to the valve unit 21. This command signal is supplied to a motor control circuit 25, whereupon the motor control circuit 25 controls an electric current supplied from a battery 10 such that a driving current is applied to a direct current motor to be described below which is comprised in the valve unit 21.

The ECU 24 also supplies a motor control circuit 26 such as a relay device, for example, with an ON/OFF command signal such that a driving current can be supplied intermittently from the battery 10 to the fan motor 12*b* via the motor control circuit 26. Thus, when the fan motor 12*b* is switched on, the radiator 2 is forcibly cooled by air cooling.

Note that in FIG. 3, the reference symbol 11 indicates a water pump which is disposed in the inflow portion 1*e* of the engine 1 and which is used to forcibly recirculate cooling water by means of the rotation of a rotary shaft caused by the rotation of a crankshaft (not shown) of the engine 1.

The reference symbol 12 indicates a fan unit for forcibly incorporating a cooling wind into the radiator 2 which is constituted by the cooling fan 12*a* and the electric motor 12*b* which rotationally drives the cooling fan 12*a*.

Figure 4:
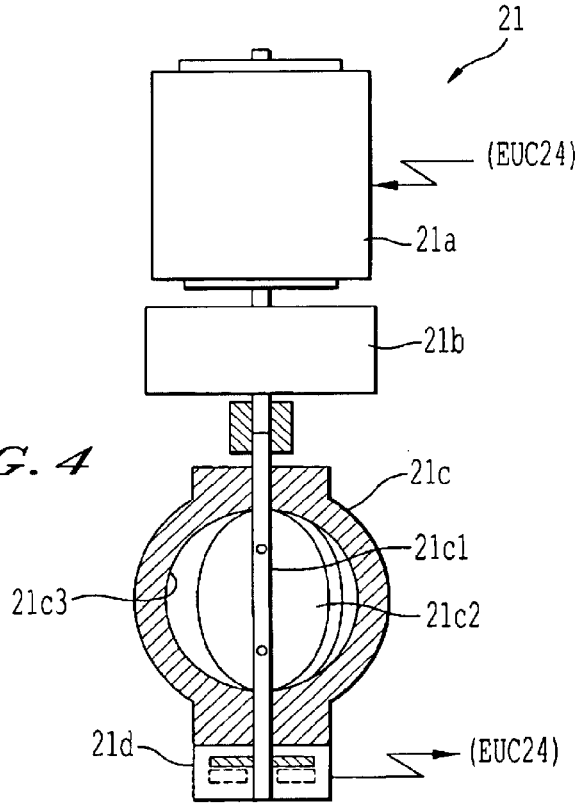
FIG. 4 is a constitutional diagram illustrating a partial cross section of a valve unit using an electronic control thermostat which serves as flow rate control means used in the device shown in FIG. 3.

FIG. 4 illustrates in outline the constitution of the valve unit 21 described above. This valve unit 21 is provided with the direct current motor 21*a* as noted above. This direct current motor 21*a* is rotationally driven in a positive direction and the opposite direction thereto upon reception of a driving current from the motor control circuit 25, and the drive shaft of the motor 21*a* is coupled to a reduction gear 21*b*.

The reduction gear 21*b* is connected to the drive shaft of the butterfly valve 21*c*. The butterfly valve 21*c* is constituted by a tubular cooling medium passage 21*c*1 and a plate-form valve 21*c*2 disposed in the passage 21*c*1. This valve 21*c*2 is formed such that the flow rate of the cooling water is controlled by the angle of rotation of a spindle 21*c*3 which serves as a drive shaft [and which rotates] at an angle in a planar direction to the flow direction of the cooling water[i]. In other words, when the angle in the planar direction to the flow direction of the cooling water is in the vicinity of 0°, the valve is open, and when the angle in the planar direction to the flow direction of the cooling water is in the vicinity of 90°, the valve is closed. By employing intermediate angles or the like, the flow rate of the cooling water can be linearly controlled.

An angle sensor 21*d* is connected to the other end portion of the spindle 21*c*3 opposing the reduction gear 21*b*, and the rotation angle (also referred to as "opening" herein below) of the butterfly valve 21*c* may be learned from this angle sensor 21*d*.

The output of the angle sensor 21*d* is supplied to the ECU 24 as described above.

Figure 5:
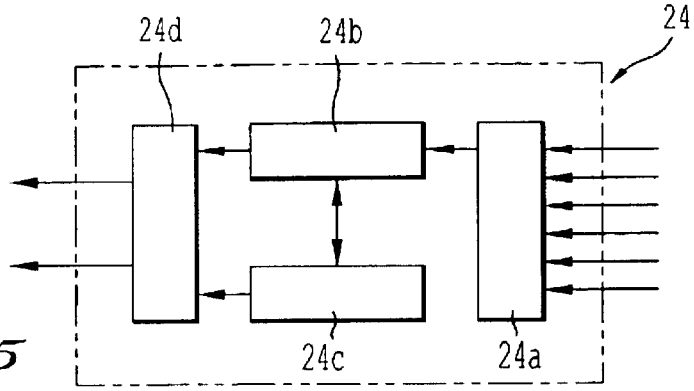
FIG. 5 is a block diagram illustrating the constitution of an engine control unit (ECU) used in the device shown in FIG. 3.

FIG. 5 illustrates the basic constitution of the ECU 24. The ECU 24 is constituted by a signal processing portion 24*a* which receives the aforementioned first through fifth information and the like and converts this information into digital signals and the like which can be recognized by an ECU, a comparing portion 24*b* which compares input data processed by the signal processing portion 24*a* to various data to be described below which are stored in a table format in memory 24*c*, and a signal processing portion 24*d* which performs calculation processing of the comparison results from the comparing portion 24*b* and outputs command signals to the valve unit 21 using an electronic control thermostat and the like.

According to the present invention constituted as above, the valve unit 21 using an electronic control thermostat is controlled such that load variation in an engine in an operative state is appropriately predicted and determined, whereupon the temperature of the cooling water is controlled appropriately and efficiently. As a result, combustion efficiency can be enhanced with a further degree of reliability and in substantially all regions of the operative state.

Figure 1:
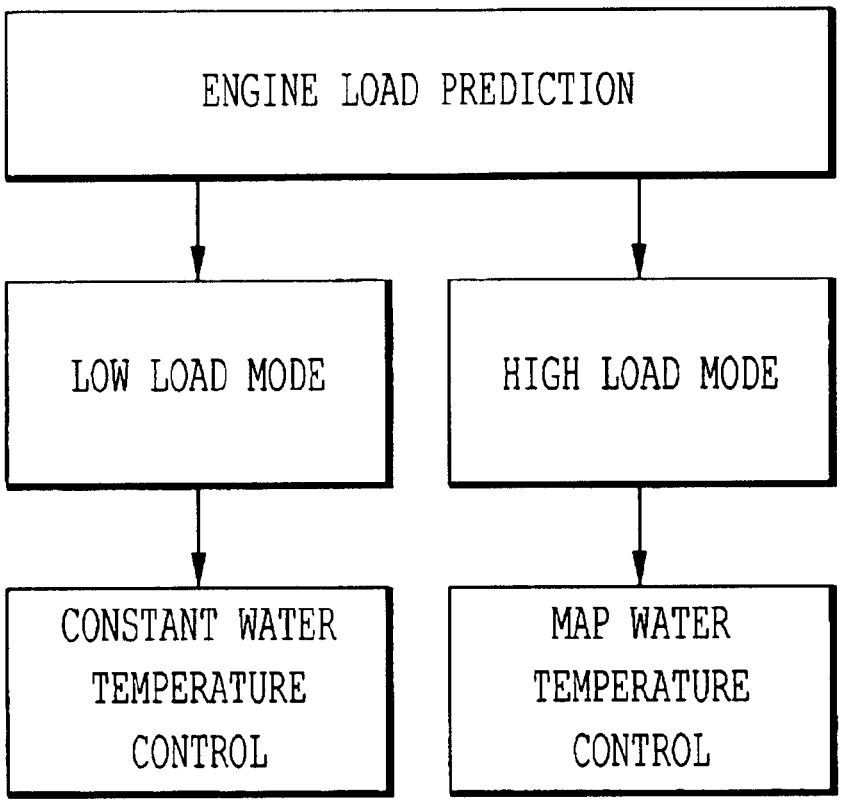
FIG. 1 is a schematic diagram illustrating in outline an embodiment of a control method for an electronic control thermostat according to the present invention.

More specifically, parameters from the various sensors which detect the state of the engine 1 are inputted into the engine control unit ECU 24. Then, as shown in FIG. 1, when the ECU 24 determines from the values of the parameters indicating the operating state of the automobile that the engine load is about to decrease, the valve unit 21 using an electronic control thermostat is controlled to a high water temperature (for example 110° C.) using constant water temperature control, and when it is determined that medium and high loads are due to increase, control of the valve unit 21 using an electronic control thermostat is switched such that map control is performed.

Here, when the accelerator opening (throttle opening) and engine rotation speed, which are parameters indicating the operating state of the automobile, satisfy predetermined conditions, the ECU 24 determines through prediction whether the engine load is in low load mode or high load mode. In other words, the ECU 24 reads the throttle opening θth and engine rotation speed Ne over a fixed period of time and determines the mode to which the operating state corresponds during that time. For example, if a state in which Ne=50% (the maximum rotation speed in the engine used being 100%) and θth=20% (fully open being 100%) continues for t=10 sec or more, it is predicted that the engine is about to enter high load mode and switching is performed from low load mode.

In the map control performed in high load mode, the engine rotation speed and the load (throttle opening), for example, are monitored as the engine operating state, and control is performed by reading a corresponding set water temperature (for example an optimum water temperature for combustion), which is required data, from a table stored in memory[ii].

High load mode indicates a state in which the engine load is high and the throttle opening θth is high. An operative state having a high proportion of high load periods is referred to as high load mode. Thus map control can be seen as being effective in modes with a high proportion of medium and high loads.

In the constant water temperature control performed in low load mode, on the other hand, control is performed differently to map control by maintaining the cooling water temperature at a high temperature (for example 110° C.).

Low load mode indicates a state in which the engine load is small and the throttle opening θth is small. An operative state having a low proportion of low load periods is referred to as low load mode. In other words, constant water temperature control at a high water temperature is more preferable to map control in a mode with a high proportion of low loads.

Constant water temperature control is performed by the ECU 24 on the basis of the throttle opening θth, the engine rotation speed Ne, and the cooling water temperature TW.

Map control is performed by the ECU 24 on the basis of the throttle opening θth, the engine rotation speed Ne, the cooling water temperature TW, the atmospheric pressure P, the intake air amount Q, the intake air humidity Hu, and the intake air temperature THA.

In such a constitution, when the cooling water temperature is controlled (control to a high water temperature at a low load and to a low water temperature at a medium or high load) in accordance with the engine load in order to enhance combustion, for example, the engine load is predicted and determined such that a judgment may be made as to whether the automobile is in high load mode or low load mode.

As an example thereof, at the time of engine start-up, the automobile is normally in low load mode. Then, if a high speed is maintained for a fixed period of time or more, or if the throttle opening increases frequently, it is determined that the automobile is in high load mode, and thus low load mode may be switched to high load mode.

When switching to high load mode, map control is performed to realize a target water temperature which accords with the load. Since the cooling water temperature falls faster than it rises, a low water temperature which is optimum for combustion is realized with high probability at the time of a high load.

In low load mode, constant water temperature control at a high water temperature (for example 110° C.) is performed. In so doing, a high water temperature which is optimum for combustion at the time of a low load can be realized in the majority of the operative state.

Note that in an automatic car, high load mode may be determined when switching to manual mode or sport mode. In a vehicle equipped with a car navigation system, control may be performed to switch to high load mode when it is determined on the basis of map information from the car navigation system that the car is traveling on an express highway or a mountain road.

Figure 2:
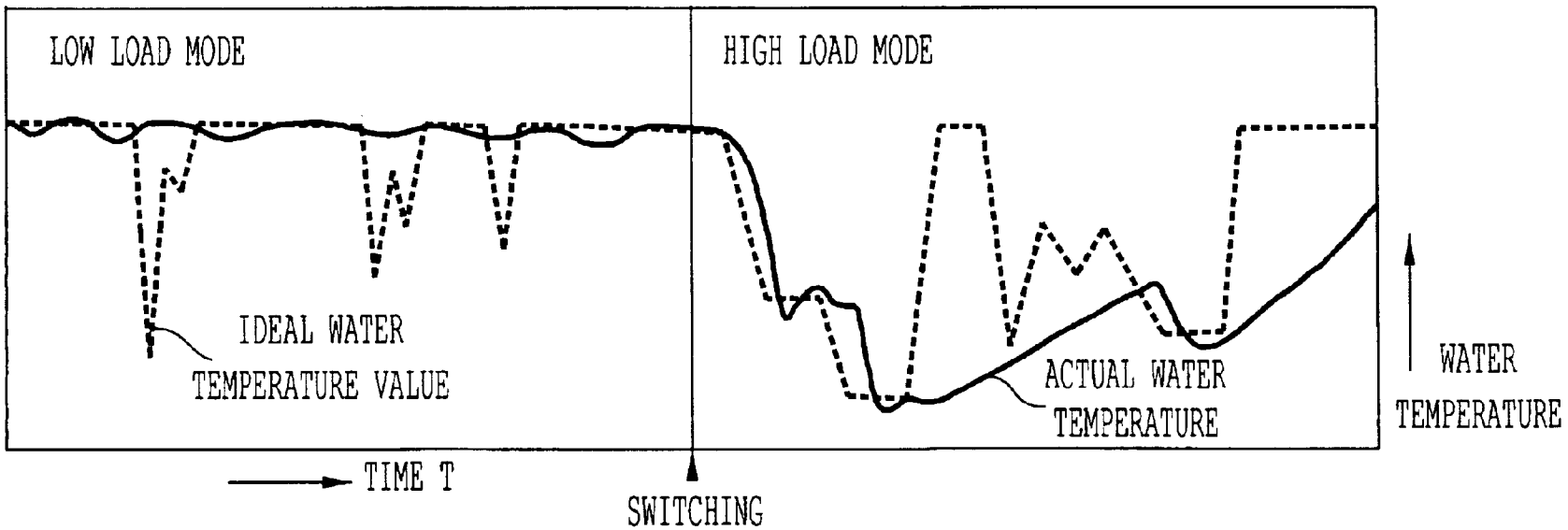
FIG. 2 is a view illustrating the relationship between the actual water temperature and an ideal water temperature value in cooling water temperatures in low load mode and high load mode to thereby illustrate the effect of performing the control in FIG. 1.

When control is performed as described above, an actual water temperature which differs little from the ideal water temperature value can be obtained in both low load mode and high load mode, as shown in FIG. 2, and an optimum water temperature for combustion can be obtained under any operative state. As a result, an enhancement in combustion efficiency can be achieved effectively. Moreover, this type of control method is skillfully combined with existing control methods known from the background art and therefore contains no problems from the point of view of cost. Combustion efficiency enhancement is achieved particularly effectively in substantially all regions of the operative state by switching between constant water temperature control and map control in accordance with the engine load, and thus a combustion efficiency enhancement effect can be achieved by a general driver under any driving conditions.

Note that it has been confirmed through experiment that by obtaining a water temperature which is optimum for combustion, an approximately 5.4% improvement in efficiency can be achieved.

Next, the flow of the control executed mainly by the ECU 24 which is illustrated from FIG. 6 onward will be described as an example of constant water temperature control of the valve unit 21 using an electronic control thermostat in the cooling control device for an automobile engine shown in FIGS. 3 through 5.

Figure 6:
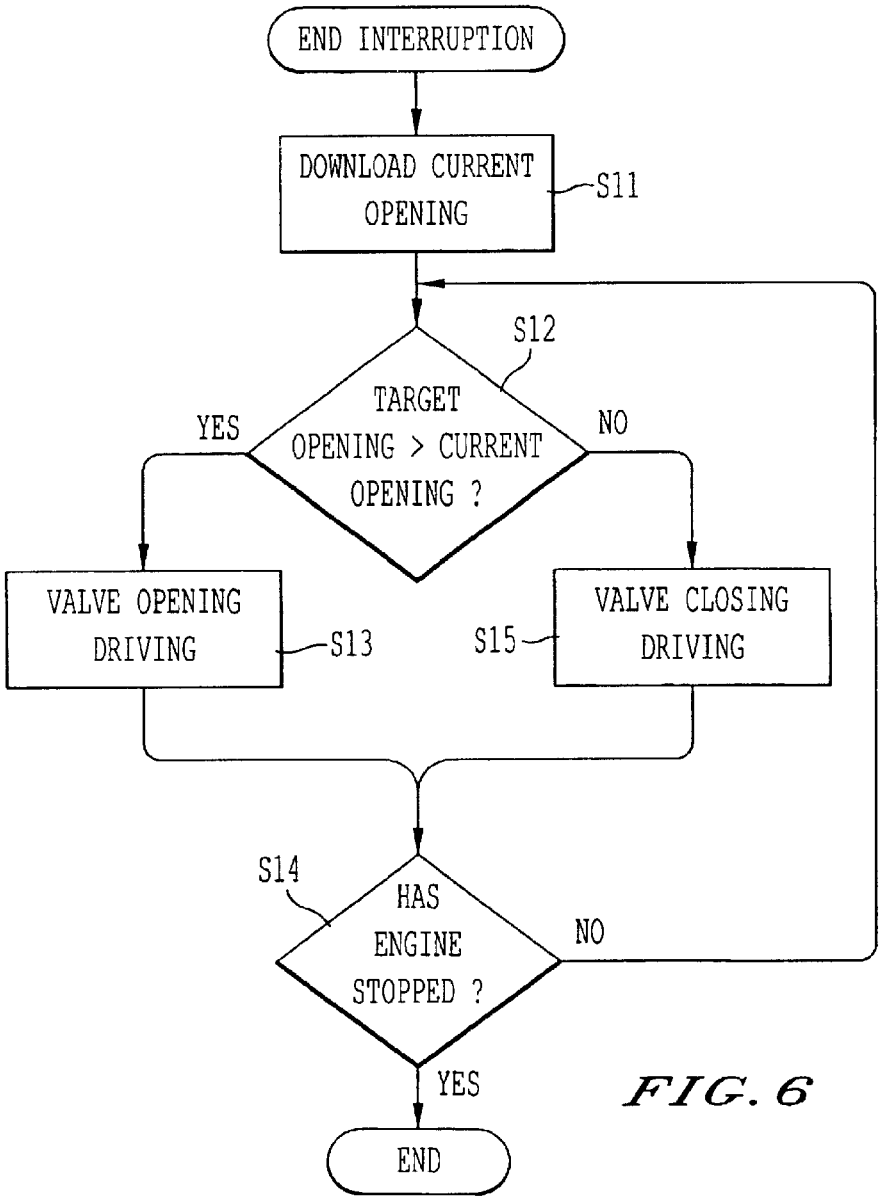
FIG. 6 is a flowchart illustrating the action of high temperature constant water temperature control in the device shown in FIG. 3.

FIG. 6 illustrates the main flow for controlling the opening of the butterfly valve. First, when the engine is activated, the current opening of the butterfly valve 21*c* is fetched in a step S11 on the basis of opening information from the angle sensor 21*d* in the valve unit 21.

Then, in a step S12, the current opening is compared with a target opening to be described below and a judgment is made as to whether or not the target opening is larger than the current opening. If the result of this judgment is YES, processing moves to a step S13 and the butterfly valve 21*c* is opened. This is achieved by transmitting a command signal from the ECU 24 to the motor control circuit 9 and applying a drive current to the direct current motor 21*a* in the valve unit 21 for a fixed amount of time in a direction for opening the butterfly valve 21*c*.

Then, in a step S14, a judgment is made as to whether or not the engine has stopped. If the engine has not stopped, processing returns to step S11 and a similar routine is repeated.

If, in step S12, it is judged that the target opening is not larger than the current opening, or in other words if the judgment result is NO, processing moves to step S15 and the butterfly valve 21*c* is closed. This is achieved similarly by transmitting a command signal from the ECU 24 to the motor control circuit 9 and applying a drive current to the direct current motor 21*a* in the valve unit 21 for a fixed amount of time in a direction for closing the butterfly valve 21*c*.

This main routine for adjusting the opening of the butterfly valve 21*c* is repeated at all times in this manner when the engine 1 is operative.

Figure 7:
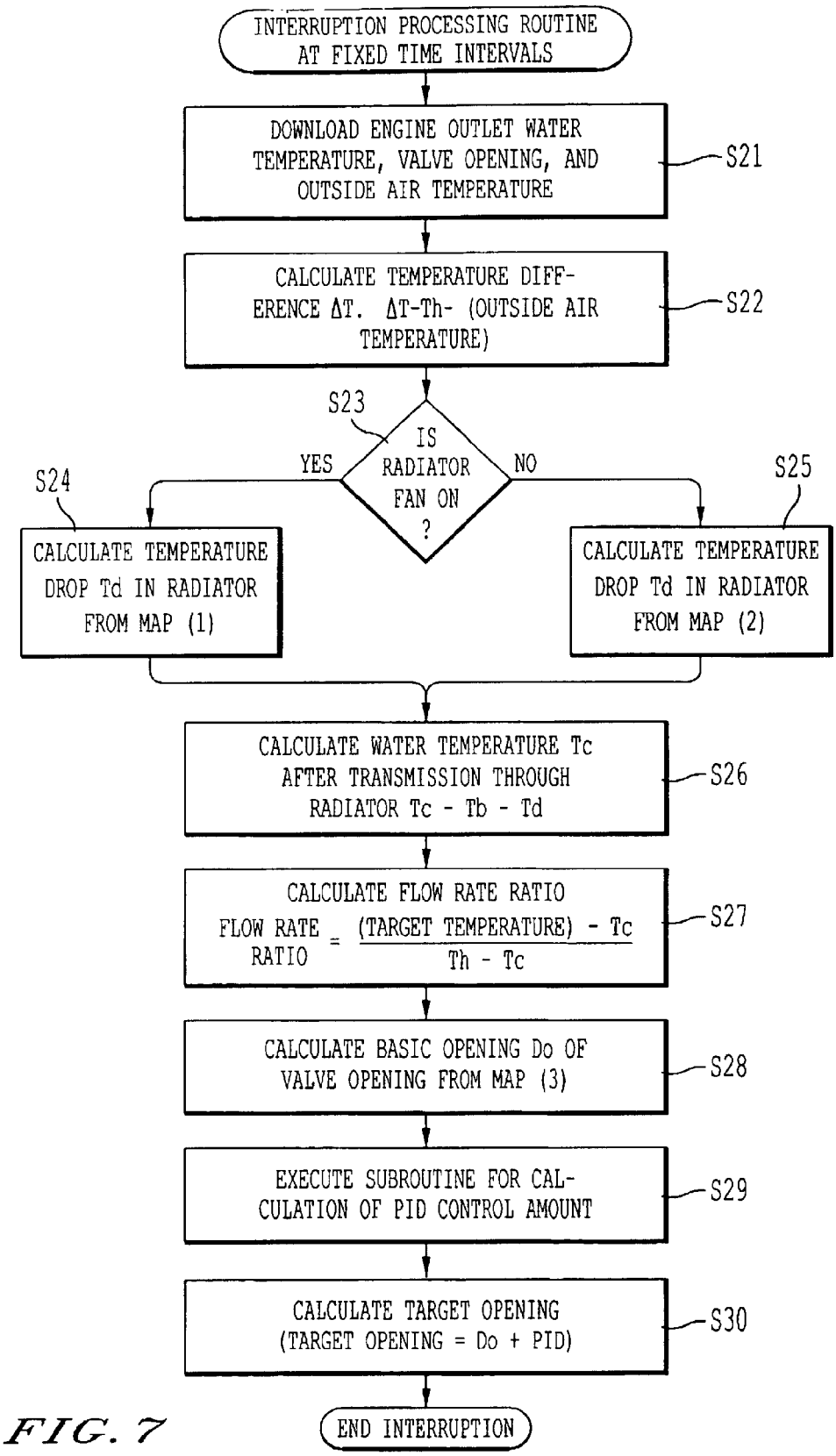
FIG. 7 is a flowchart illustrating a first embodiment of an interruption processing routine relating to the routine shown in FIG. 6.

FIG. 7 illustrates a first embodiment of an interruption processing routine for interrupting the main routine at fixed time intervals.

More specifically, the engine outlet water temperature (third information), valve opening (second information), and outside air temperature (fourth in formation) are fetched at fixed time intervals, for example, in a step S21. The engine outlet water temperature may be obtained from the temperature detecting element 22, the valve opening may be obtained from the angle sensor 21*d* in the valve unit 21, and the outside air temperature may be obtained from a temperature detector or the like not shown in the drawing.

Then, in a step S22, ΔT, which is the difference between the engine outlet water temperature Th and the outside air temperature, is determined. Processing then moves to a step S23, in which a judgment is made as to whether or not the radiator fan is on. This a judgment of whether or not the fan 12*a* serving as forcible cooling means is operative, and may be determined by the presence or absence of a drive command signal for the fan motor 12*b* outputted from the ECU 24 itself.

Figures 8, 9:
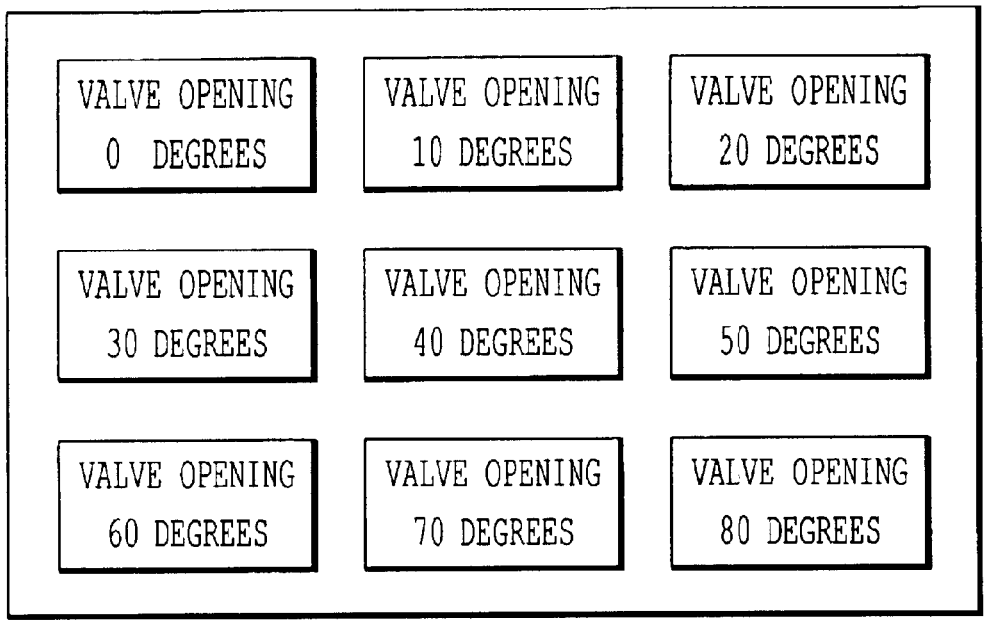
FIG. 8 is a constitutional diagram illustrating the form of a map which is used in the processing routine shown in FIG. 7.
FIG. 9 is a constitutional diagram illustrating the form of another map which is used in the processing routine shown in FIG. 7.

Here, if it is judged that the radiator fan is on (YES), processing moves to a step S24, in which maps (1) in table format as shown in FIG. 8 are read out and the temperature drop Td in the radiator is calculated.

FIG. 8 illustrates maps corresponding to the valve opening. Detailed drawings thereof have been omitted, but temperature drop data Td for the radiator 2 are preset in accordance with each valve opening. These temperature drop data Td are determined by the temperature difference ΔT determined in step S22, or in other words by the relationship Th−outside air temperature, and temperature drop data are listed according to each relationship. Accordingly, the radiator temperature drop data Td are determined from such maps (1).

Note that the maps (1) in table format shown in FIG. 8 are shown two-dimensionally due to their realization on a paper surface, but these maps are stored in the memory 24*c* in FIG. 3 as three-dimensional data.

Also note that in FIG. 8, maps corresponding to nine valve openings are shown for convenience of explanation and also due to the paper surface, and temperature drop data are set in accordance with each of these valve openings, but by creating so-called interpolations therebetween, temperature drop data Td corresponding to intermediate values can be determined.

Returning to FIG. 7, if it is judged in step S23 that the radiator fan is not on (NO), processing moves to a step S25 and the radiator temperature drop Td is calculated from a map (2). This map (2) has a similar form to the maps shown in FIG. 8 and so on, and accordingly a plurality of numerical values corresponding to temperature drop data Td is described according to the characteristic when the radiator fan is on.

This map (2) is also stored in the memory 24*c* in FIG. 5, similarly to the map (1), and four-dimensional data comprising the map (1) and the map (2) may be constructed.

Next, in a step S26, the water temperature Tc (=Th−Td) following transmission through the radiator is calculated from the temperature drop data Td calculated in step S24 or step S25 and the engine outlet water temperature Th fetched in step S21.

Then, in a step S27, a flow rate ratio is calculated using Tc determined in step S26. This flow rate ratio is calculated from the target temperature of the cooling water which flows into the engine, Tc, and the engine outlet water temperature Th. In other words, flow rate ratio=[(target temperature)−Tc]/[Th−Tc] may be calculated.

Processing then moves to a step S28, in which a basic opening D0 of the valve opening is calculated from a map (3). An example of this map (3) is shown in FIG. 9, and the basic valve opening D0 corresponding to the flow rate ratio determined in step S27 can be obtained from the map (3) shown in FIG. 9.

By setting the opening of the butterfly valve 21*c* to the basic valve opening D0 which is determined in the above manner, the temperature of the cooling water which flows into the engine is logically set to the aforementioned target temperature. In actuality, however, a state in which the cooling water temperature does not converge in the vicinity of the target temperature arises due to various elements of disturbance. Hence a subroutine for calculating a PID control amount is executed in a step S29. By means of this PID (follow-up control amount) calculation, opening data in a minutely positive or negative direction are calculated to correct the temporal delay which occurs while the valve opening changes such that the cooling water temperature reaches the temperature of the cooling water at the engine inlet.

Next, in a step S30, the target opening of the valve is calculated. This target temperature is equivalent to the PID control amount calculated instep S28 added as a correction value to the basic opening D0 calculated in step S28.

$$(\text{target opening}=D0+PID)$$

The target opening obtained in this manner is used as the target opening of step S12 in the main routine shown in FIG. 6.

Hence by means of the action of the main routine, the opening of the butterfly valve 21*c* can be adjusted such that the temperature of the cooling water which flows into the engine is set substantially at the target temperature. Note that in step S29, a subroutine for calculating the PID control amount is executed, but more ideal open/close control of the valve may be achieved by constructing this subroutine such that the target opening of the valve is also set by a correction value determined by fuzzy control in addition to PID control.

Figure 10:
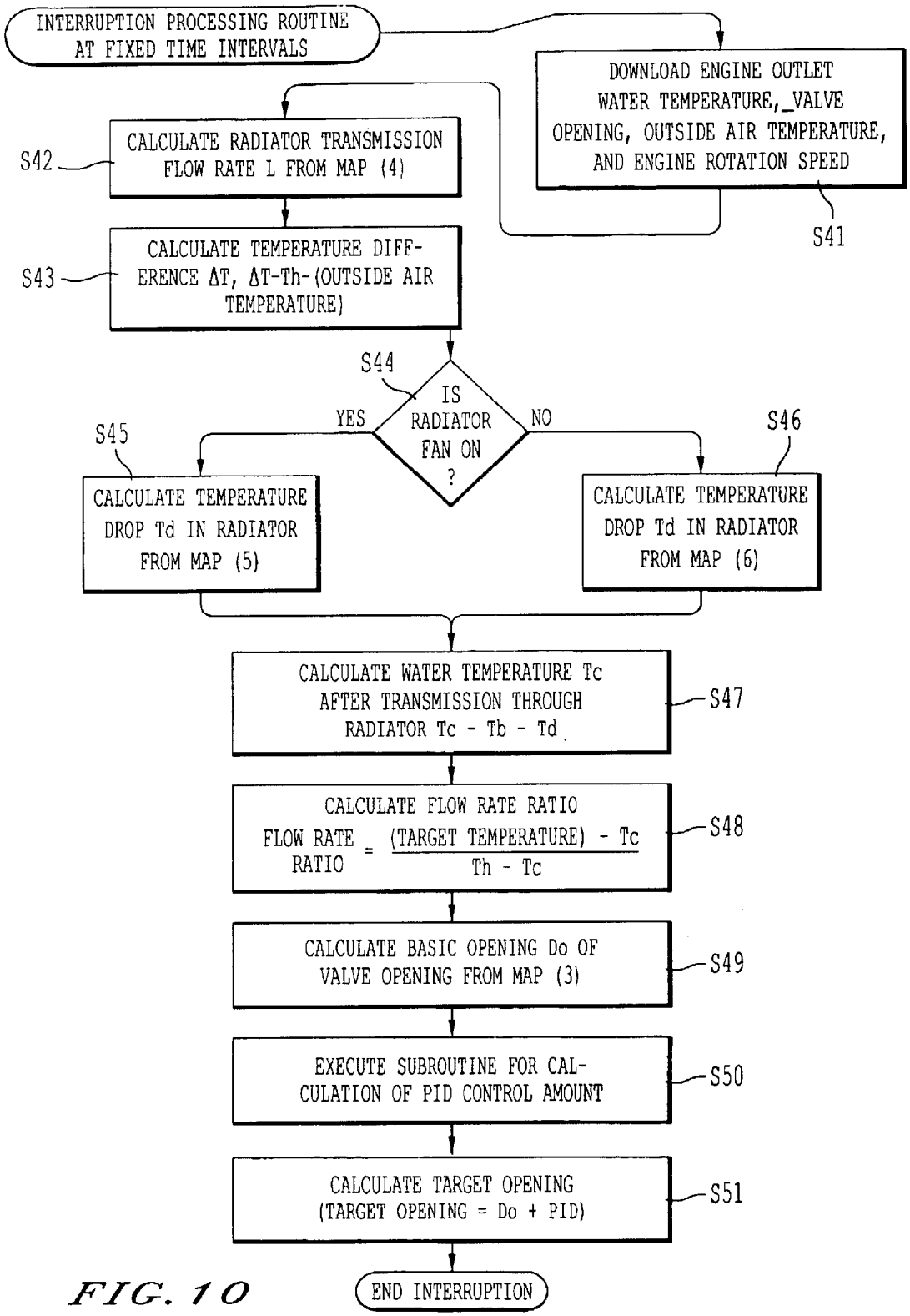
FIG. 10 is a flowchart illustrating a second embodiment of an interruption processing routine relating to the routine shown in FIG. 6.

FIG. 10 illustrates a second embodiment of an interruption processing routine for interrupting the main routine shown in FIG. 6 at fixed time intervals. Note that the majority of the interruption processing routine shown in FIG. 10 is identical to the interruption processing routine shown in FIG. 7, and the description provided below focuses mainly on the differences with the routine shown in FIG. 7.

First, in a step S41 at fixed time intervals, the engine outlet water temperature (third information), valve opening (second information), outside air temperature (fourth information), and engine rotation speed (fifth information) are fetched. This step S41 differs from step S21 in FIG. 7 in that the engine rotation speed (fifth information) is also fetched.

Information relating to the engine rotation speed is also used as a parameter because the water pump 11 is driven by the engine torque, and thus the issue rate of cooling water changes in accordance with the engine rotation speed.

Next, in a step S42, a transmission flow rate L through the radiator is determined from a map (4). An example of the map (4) is shown in FIG. 11, and the transmission flow rate L of cooling water through the radiator can be determined in accordance with the engine rotation speed and valve opening.

Processing then moves to a step S43, but since steps S43 through S46 are identical to steps S22 through S25 in FIG. 7, description thereof has been omitted. Note, however, that a map (5) used in step S45 is that shown in FIG. 12.

FIG. 12 illustrates the radiator temperature drops Td according to one valve opening from among each of the maps corresponding to valve openings shown in FIG. 8. These temperature drop data Td are formed into a matrix of the temperature difference ΔT determined in step S43, or in other words Th−outside air temperature, and the radiator transmission flow rate L determined in step S42, and temperature drop data Tdxx are noted in accordance with each. Thus radiator temperature drop data Td are determined from this type of map (5).

A map (6) which is used in a step S46 also has an identical form to that shown in FIG. 12. Note, however, that the numerical values of the temperature drop data Tdxx in FIG. 12 differ in deriving from the cooling characteristic when the radiator fan is on.

The temperature drop data Tdxx are determined from the map (5) or map (6) in this manner, and then the routine shown in steps S47 through S51 is executed. However, these steps are identical to steps S26 through S30 in FIG. 7, and hence description thereof has been omitted.

A further similarity lies in that the target opening determined in the interruption processing routine shown in FIG. 10 is used as the target temperature of step S12 in the main routine shown in FIG. 6.

An example of map control of the valve unit 21 using an electronic control thermostat by the ECU 24 in the engine cooling water temperature control system according to FIGS. 3 to 5 will be described below using FIG. 13 and so on.

Note that in FIG. 13, the central processing unit (CPU) 51 in the ECU 24 inputs and calculates data inputted from the sensors in accordance with a control program, and as is well known, also performs processing for controlling a fuel injection valve, igniter, and various actuators such as an ISCV, which are not shown in the drawings, as well as the valve unit 21.

Read only memory (ROM) 52 is a storage device for storing the aforementioned control program and data such as an ignition timing calculation map. Random access memory (RAM) 53 is a storage device to/from which data outputted from the sensors and data required for calculation control are temporarily written and read. Backup random access memory (backup RAM) 54 is a storage device in which data required for engine driving and the like are provided with backup from a battery source even when an ignition switch, not shown, is off.

An input portion 55 performs waveform shaping of input signals from the various sensors such as the pressure sensor 42 and the air flow meter 43 using a waveform shaping circuit, not shown, and selectively outputs these signals to the CPU 51 through a multiplexer, not shown. If the output signals of the sensors are analog signals in the input portion 55, the signals are converted to digital signals by an A/D converter 57.

An input/output portion 56 uses a waveform shaping circuit to perform waveform shaping of the input signals from the rotation angle sensor 46 and the like which serve as the basis for engine rotation speed Ne signals, and then writes these signals into the RAM 53 and the like via an input port. The input/output port 56 also drives the fuel injection valve, igniter, and ISCV, not shown, as well as the valve unit 21, at a predetermined timing and to a predetermined amount using a driving circuit which is driven by a command from the CPU 51 via an output port.

Here, a bus line 58 connects various elements such as the CPU 51 and the ROM 52 to the A/D converter 57 and input/output portion 56 which are connected to the input portion 55, and transmits various data therebetween.

As well as controlling the fuel injection valve, igniter, and various actuators such as the ISCV 17, as noted above, the ECU 50$^{iii}$ controls the valve unit 21 to an appropriate degree of opening. That is, the CPU 51 inside the ECU 50 executes the processing in the flowchart described below in accordance with a program stored in the ROM 52 to control the valve unit 21.

Next, a routine for controlling the temperature of cooling water by map control will be described using FIG. 14.

Figure 14:
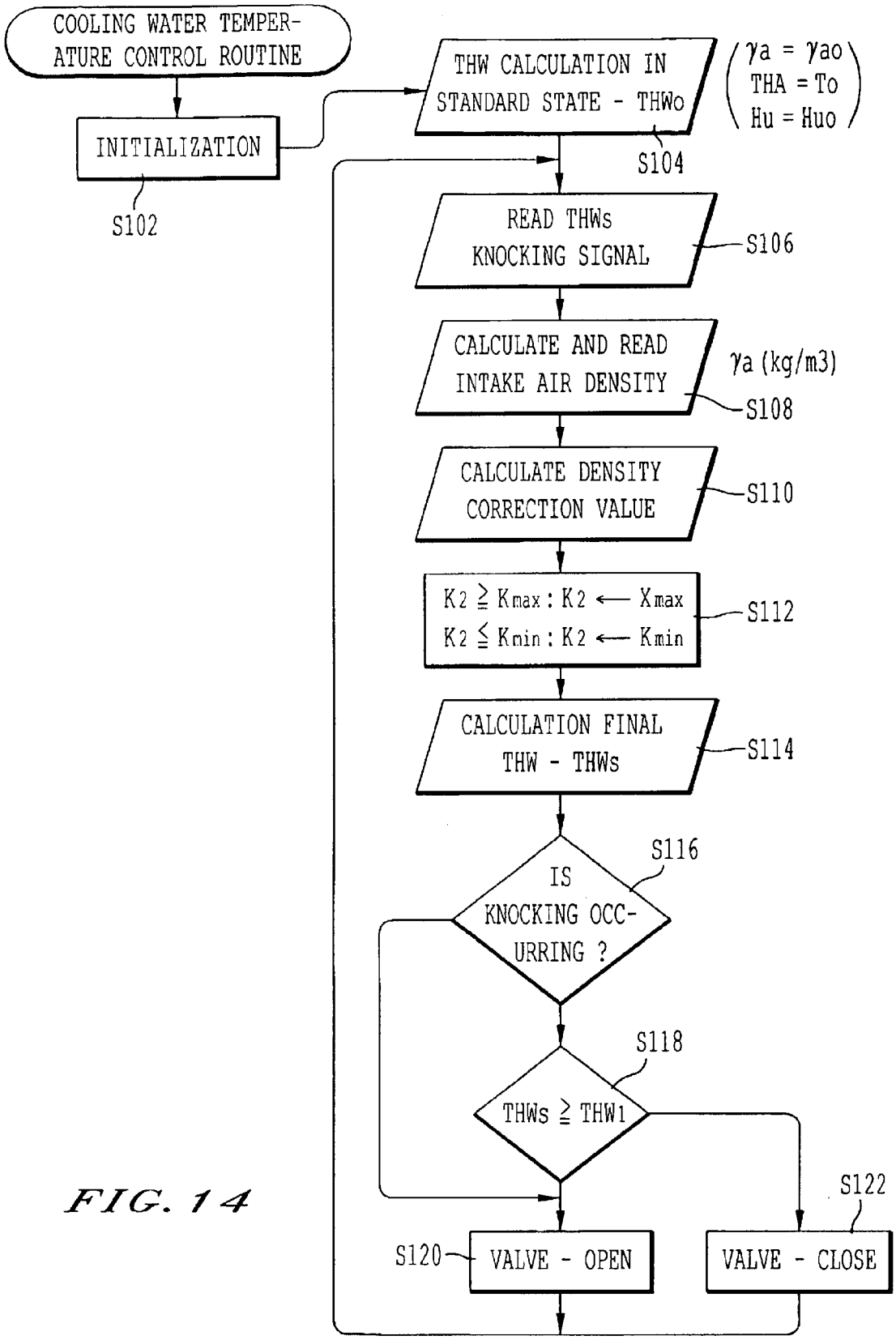
FIG. 14 is a flowchart for illustrating a map control action in the device shown in FIG. 13.

The cooling water temperature control routine shown in FIG. 14 is activated by interruption at predetermined time intervals. When this routine is activated, first, in a step S102, the CPU 51 is activated and input data from the various sensors 22, 42 to 48 are read.

Next, in a step S104, a cooling water temperature THW at which combustion is performed most favorably is determined from a preset map (not shown) with the engine rotation speed Ne and the load Q/Ne as parameters, and this is set as a target value THW0 for cooling water temperature control. More specifically, from among the various input data in step S102, values for the engine rotation speed Ne and the engine load Q/Ne are calculated from the input data of the rotation angle sensor 46 and the input data of the rotation angle sensor 46 and the air flow meter 43 respectively, and by applying these values to the aforementioned map, the cooling water temperature THW0 at which combustion is performed most favorably in the current operating state is obtained.

Here, the map used in this map control is obtained by experientially determining and then plotting the cooling water temperature at which combustion is performed most favorably with the engine rotation speed Ne and the load Q/Ne as parameters in a standard state (for example atmospheric density $\gamma a\mathbf{0}$=1.2 kg/m$^3$, intake air temperature T0=20° C., intake air humidity Hu0=50%). The map is stored in the ROM 52 inside the ECU 50.

In other words, the cooling water temperature at which combustion is performed most favorably is not always constant, but tends to increase as rotation decreases toward a low load region and to decrease as rotation increases toward a high load region. Hence the value expressing the engine load, which is the ordinate in this map, is not limited to a value of the intake air amount Q divided by the engine rotation speed Ne, but may be a fuel injection amount Qf calculated within the ECU 50 or the throttle valve opening θth detected by the throttle position sensor 47.

Next, in a step S106, the cooling water temperature THWs at the current time in the engine outlet portion and a knocking signal which indicates whether or not knocking is currently occurring are read from the water temperature sensor 22 and the KCS 48 respectively. Then, in a step S108, the atmospheric pressure P around the engine 1 at the current time and the intake air temperature THA at the current time are read from an output signal of the pressure sensor 42 and an output signal of the intake air temperature sensor 44 respectively. The density of the intake air (=density of the atmosphere around the engine 1; to be referred to hereinafter as intake air density) γa is then calculated and determined, and the value thereof is read.

Generally, the density of a gas is understood to be the coefficient between pressure and temperature determined by the equation for an ideal gas state PV=RT. Accordingly, in this embodiment a predetermined calculation is performed by inputting output signals from the pressure sensor 42 and intake air temperature sensor 44 as noted above, whereby the intake air density γa can be determined. In other words, in this embodiment the pressure sensor 42 and intake air temperature sensor 44 function as a density sensor for detecting the density of the intake air.

The cooling water temperature THWs, knocking signal, atmospheric pressure P, and intake air temperature THA which are read in steps S106, S108 are each read out once in step S102, and are updated in steps S106, S108.

Next, in a step S110, a correction value K2 corresponding to the intake air density γa at the current time which is read out in step S108 is determined from a map (not shown) indicating a correction value K2 corresponding to the intake air density γa. This correction value K2 is a correction value for correcting the target temperature THW0 for the cooling water temperature in a standard state (intake air density $\gamma a\mathbf{0}$=1.2 kg/m$^3$), determined in step S104, to a target value for the current air intake density.

The target value THW0 in the standard state is corrected by the addition of the correction value K2 as is explained herein below. Hence the correction value K2 of the intake air density $\gamma a\mathbf{0}$ in the standard state is set at zero. Note that this map is determined in advance experientially, similarly to the aforementioned maps.

Next, in a step S112, a predetermined guard is attached to the correction value K2 calculated in step S110 using the current intake air temperature THA read out in step S108. More specifically, a map expressing an upper limit guard Kmax and a lower limit guard Kmin corresponding to the intake air temperature THA is used to attach a guard. Here, the upper and lower limit guards Kmax, Kmin are set using the intake air temperature THA obtained from the intake air temperature sensor 44 such that when the correction value K2 exceeds the upper and lower limit guards Kmax, Kmin, K2 is set to equal Kmax or to equal Kmin. The fundamental concepts behind the upper and lower limit guards Kmax, Kmin are the prevention of excessive correction, maintenance of a minimum water temperature during intense cold, and prevention of overheating during intense heat.

Next, in a step S114, a final target value THWf for controlling the temperature of the cooling water is calculated using the following equation.

$$THWf = THW\mathbf{0} + K\mathbf{2} \quad (1)$$

Next, in a step S116, a judgment is made using the knocking signal read out in step S106 as to whether or not knocking is currently occurring.

If knocking is not occurring, processing advances to a step S118, in which the current cooling water temperature THWs read out in step S106 is compared to the final target value THWf for the cooling water temperature which was calculated in step S114.

If the cooling water temperature THWs exceeds the target value THWf, processing advances to a step S120, and in step S120 the valve unit 21 is driven further in the direction of opening from the current degree of opening.

When the valve unit 21 is driven in the direction of opening, or in other words the degree of opening of the valve unit 21 is increased, the proportion of cooling water flowing through the low temperature side cooling water passage 3*b* increases beyond that flowing through the high temperature side bypass water passage 3*c*, and the temperature of the cooling water on the inlet side of the engine 1 decreases. Thus the detected cooling water temperature THWs is controlled in a direction nearing the final target value THWf.

If, in step S118, the cooling water temperature THWs is less than the target value THWf, processing advances to a step S122 in which the valve unit 21 is driven in the direction of closing from the current degree of opening.

When the valve unit 21 is driven in the direction of closing, or in other words the degree of opening of the valve unit 21 is decreased, in contrast to the above the proportion of cooling water flowing through the high temperature side bypass water passage 3*c* increases beyond that flowing through the low temperature side cooling water passage 3*b*, and the temperature of the cooling water on the engine inlet side increases. Thus in this case also the detected cooling water temperature THWs is controlled in a direction nearing the final target value THWf.

After performing the processing in either step S120 or step S122, step S106 is returned to and the processing of step S106 onward is repeated.

By repeating the processing in steps S118, S120, and S122 in this manner, the valve unit 21 is feedback controlled such that the cooling water temperature THWs matches the final target value THWf.

When it is judged in step S116 that knocking is occurring, step S120 is advanced to unconditionally and the cooling water temperature is reduced. By reducing the temperature on the wall faces of the combustion chamber, knocking can be prevented.

In order to prevent knocking by reducing the temperature on the wall faces of the combustion chamber in this embodiment, the aforementioned KCS 48 is controlled so as not to execute an ignition lag even when knocking is detected.

According to the cooling water temperature control routine shown in FIG. 14, the correction value K2 is obtained from the aforementioned map with a value which increases as the intake air density γa decreases, and the cooling water temperature THWs is feedback controlled to a slightly high final target value THWf which is obtained by the equation (1) noted above. As a result, the temperature of the cooling water on the engine inlet side increases and the cooling ability decreases.

Conversely, the cooling water temperature THWs is feedback controlled to a slightly low final target value THWf by the correction value K2 which decreases in value as the intake air density γa increases (when the cooling water temperature THWs is higher than the intake air density γa in the standard state, the correction value K2 is a negative value). As a result, the temperature of the cooling water on the engine inlet side decreases and the cooling ability increases.

Note that the present invention is not limited to the constitution described in the aforementioned embodiment, and the form, constitution, and so on of each component may be altered or modified appropriately.

For example, the electronic control thermostat described in the aforementioned embodiment is preferably constituted such that the target temperature can be set arbitrarily, or more specifically is constituted by a butterfly valve which is advantageous for flow rate control and driven by a DC motor via a bevel gear. The electronic control thermostat is not limited thereto, however, and any electronic control thermostat which is capable of performing arbitrary temperature control may be applied.

Further, the maps described in the aforementioned constant water temperature control at a high water temperature and map control are not limited to those specified in the drawings or description, but may be freely employed in various forms. Moreover, the descriptions in each type of control are merely examples thereof and various forms may be employed within the scope of the spirit of the present invention.

Further, in the embodiment described above an example was described in which the valve unit 21 using an electronic control thermostat is provided in a position to perform control of the engine outlet, but the valve unit 21 may of course be provided in a position to perform control of the engine inlet.

INDUSTRIAL APPLICABILITY

According to the control method for an electronic control thermostat according to the present invention as described above, variation in the engine load in an operative state is predicted and determined appropriately, and temperature control of the cooling water is performed by the electronic control thermostat appropriately and efficiently. As a result, combustion efficiency can be enhanced with a higher degree of reliability and in substantially all regions of the operative state.

Furthermore, this type of control method is skillfully combined with existing control methods known from the background art and therefore contains no problems from the point of view of cost. Combustion enhancement is achieved particularly effectively in substantially all regions of the operative state by switching between constant water temperature control and map control in accordance with the engine load, and thus a combustion efficiency enhancement effect can be achieved by a general driver under any driving conditions.

Also according to the present invention, control switching is not performed frequently, and thus this control is simple, cost effective, and able to solve problems regarding response.

What is claimed is:

1. A control method for an electronic control thermostat in an automobile engine cooling water temperature control system in which the temperature of cooling water is set variably by an electronic control thermostat in accordance with the engine load, characterized in that parameters from a variety of sensor types which detect the state of the engine are inputted into an engine control unit, and when said engine control unit determines from the values of the parameters indicating the operative state of the automobile that the engine load is about to decrease, control is switched in said electronic control thermostat to a control method in which a target water temperature for controlling said cooling water temperature is maintained at a fixed high temperature at all times, and when said engine control unit determines that medium or high loads are due to increase, control is switched in said electronic control thermostat to a control method in which a target temperature corresponding to said parameter values is read from said engine control unit.

2. The control method for an electronic control thermostat according to claim 1, characterized in that when the accelerator opening and the engine rotation speed, which are parameters indicating the operative state of the automobile, satisfy predetermined conditions, said engine control unit determines by prediction whether the engine load is low load, medium load, or high load.

3. The control method for an electronic control thermostat according to claim 1, characterized in that the control performed by said engine control to maintain said cooling water temperature at a high temperature in said electronic control thermostat is performed on the basis of the throttle opening, the engine rotation speed, and the cooling water temperature.

4. The control method for an electronic control thermostat according to claim 1, characterized in that the control of said electronic control thermostat which is performed by reading a target temperature corresponding to said parameter values from said engine control unit is performed on the basis of at least one of or any combination of the throttle opening, the engine rotation speed, the cooling water temperature, the atmospheric pressure, the intake air amount, the intake air humidity, or the intake air temperature.

5. The control method for an electronic control thermostat according to claim 1, characterized in that said electronic control thermostat is capable of variably controlling the cooling water temperature to any temperature, and is disposed in an engine cooling water passage on either the inlet side or the outlet side of the engine.

6. The control method for an electronic control thermostat according to claim 2, characterized in that the control performed by said engine control to maintain said cooling water temperature at a high temperature in said electronic control thermostat is performed on the basis of the throttle opening, the engine, rotation speed, and the cooling water temperature.

7. The control method for an electronic control thermostat according to claim 2, characterized in that the control for said electronic control thermostat which is performed by reading a target temperature corresponding to said parameter values from said engine control unit is performed on the basis of at least one of or any combination of the throttle opening, the engine rotation speed, the cooling water temperature, the atmospheric pressure, the intake air amount, the intake air humidity, or the intake air temperature.

8. The control method for an electronic control thermostat according to claim 3, characterized in that the control of said electronic control thermostat which is performed by reading a target temperature corresponding to said parameter values from said engine control unit is performed on the basis of at least one of or any combination of the throttle opening, the engine rotation speed, the cooling water temperature, the atmospheric pressure, the intake air amount, the intake air humidity, or the intake air temperature.

9. The control method for an electronic control thermostat according to claim 6, characterized in that the control of said electronic control thermostat which is performed by reading a target temperature corresponding to said parameter values from said angina control unit is performed on the basis of at least one of or any combination of the throttle opening, the engine rotation speed, the cooling water temperature, the atmospheric pressure, the intake air amount, the intake air humidity or the intake air temperature.

10. The control method for an electronic control thermostat according to claim 2, characterized in that said electronic control thermostat is capable of variably controlling the cooling water temperature to any temperature, and is disposed in an engine cooling water passage on either the inlet side or the outlet side of the engine.

11. The control method for an electronic control thermostat according to claim 3, characterized in that said electronic control thermostat is capable of variably controlling the cooling water temperature to any temperature, and is disposed in an engine cooling water passage on either the inlet side or the outlet side of the engine.

12. The control method for an electronic control thermostat according to claim 4, characterized in that said electronic control thermostat is capable of variably controlling the cooling water temperature to any temperature, and is disposed in an engine cooling water passage on either the inlet side or the outlet side of the engine.

13. The control method for an electronic control thermostat according to claim 6, characterized in that said electronic control thermostat is capable of variably controlling the cooling water temperature to any temperature, and is disposed in an engine cooling water passage on either the inlet side or the outlet side of the engine.

14. The control method for an electronic control thermostat according to claim 7, characterized in that said electronic control thermostat is capable of variably controlling the cooling water temperature to any temperature, and is disposed in an engine cooling water passage on either the inlet side or the outlet side of the engine.

15. The control method for an electronic control thermostat according to claim 8, characterized in that said electronic control thermostat is capable of variably controlling the cooling water temperature to any temperature, and is disposed in an engine cooling water passage on either the inlet side or the outlet side of the engine.

16. The control method for an electronic control thermostat according to claim 9, characterized in that said electronic control thermostat is capable of variably controlling the cooling water temperature to any temperature, and is disposed in an engine cooling water passage on either the inlet side or the outlet side of the engine.

* * * * *

UNITED STATES PATENT AND TRADEMARK OFFICE

CERTIFICATE OF CORRECTION

PATENT NO. : 6,817,321 B2
DATED : November 16, 2004
INVENTOR(S) : Toshiharu Takei et al.

It is certified that error appears in the above-identified patent and that said Letters Patent is hereby corrected as shown below:

Column 10,
Line 18, please change “in formation” to -- information --.

Column 11,
Line 37, please change “instep” to -- in step --.

Column 18,
Line 3, please change “angina” to -- engine --.

Signed and Sealed this

Twenty-sixth Day of April, 2005

JON W. DUDAS
*Director of the United States Patent and Trademark Office*